US005172614A

United States Patent [19]

Monnet et al.

[11] Patent Number: 5,172,614

[45] Date of Patent: Dec. 22, 1992

[54] COMPOSITE IMPROVED WRENCH

[75] Inventors: Pierre Monnet, Moutiers; Jean P. Demurger, Roanne, both of France

[73] Assignee: Demurger et Cie, France

[21] Appl. No.: 730,822

[22] PCT Filed: Dec. 21, 1990

[86] PCT No.: PCT/FR90/00936

§ 371 Date: Jul. 25, 1991

§ 102(e) Date: Jul. 25, 1991

[87] PCT Pub. No.: WO91/09708

PCT Pub. Date: Jul. 11, 1991

[30] Foreign Application Priority Data

Dec. 22, 1989 [FR] France ..... 89 17396

[51] Int. Cl.[5] ..... B25B 13/02

[52] U.S. Cl. ..... 81/119; 81/125.1; 81/177.1

[58] Field of Search ..... 81/119, 121.1, 124.7, 81/125.1, 177.1, 177.4, 124.4

[56] References Cited

U.S. PATENT DOCUMENTS

| | | |
|---|---|---|
| 1,793,714 | 2/1931 | Newberg . |
| 2,083,131 | 6/1937 | Tornebohm . |
| 2,909,954 | 10/1959 | Rhoads . |
| 3,298,260 | 1/1967 | Rothenberg . |
| 4,738,169 | 4/1988 | Wyka . |

FOREIGN PATENT DOCUMENTS

| | | |
|---|---|---|
| 1973393 | 11/1967 | Fed. Rep. of Germany . |
| 1010953 | 6/1952 | France . |
| 1251419 | 10/1971 | United Kingdom . |

*Primary Examiner*—D. S. Meislin
*Attorney, Agent, or Firm*—Wall and Roehrig

[57] ABSTRACT

An improved wrench has clamping or gripping jaws at each end of an elongated handle, and is configured as an open-end type, ring or polygonal socket wrench. The clamping jaws are disposed in two separate, non-parallel planes and are extended into the handle, intersecting therein at an angle varying from 90 to 170 degrees, such that handle has a biplanar structure of greatly enhanced strength.

12 Claims, 2 Drawing Sheets

COMPOSITE IMPROVED WRENCH

The invention relates to a composite improved wrench, that is to say one which is produced from plastic and the nut-engaging heads of which comprise an embedded metal insert forming a clamping bit or jaw. However, this invention can be adapted perfectly well to traditional steel wrenches.

The production of composite wrenches has already been known for a long time (see, for example, US-A-2,909,954, GB-A-1,251,419). Nevertheless, this type of wrench has undergone virtually no development in view of its prohibitive disadvantages.

In fact, whatever the shape or dimensional characteristics of the metal inserts, the wrenches obtained are unsatisfactory, on the one hand because said inserts tend to rotate in the head, and on the other hand because the strength of the wrenches is often scarcely different from that of the plastic handle, thus considerably restricting their use, and at all events is below the lower limit of the industrial standards in force at the present time.

The U.S. Pat. No. 1,793,714 describes a wrench which has a head at each of its ends, but in which the two heads are arranged in two separate nonparallel planes intersecting at the center of the wrench along a line perpendicular to the general direction of the handle of the wrench. Although this embodiment has the advantage of assisting work in terms of the particular location, especially nuts of difficult access, nevertheless the special morphology of the handle, changing the way in which the wrench is grasped, reduces the amount of force which can be exerted on the handle, thereby making this type of wrench of limited use.

The invention mitigates these disadvantages. It is aimed at an improved wrench of the type in question, that is to say one produced from plastic advantageously reinforced with glass fibers and having metal inserts in the region of the heads for performing the function of clamping bits or jaws, which is easy to manufacture and, above all, do (sic) not have the above-described disadvantages, especially where strength is concerned. More specifically, the invention relates to an improved wrench which is light and the overall size of which is comparable to that of corresponding metal wrenches in existence at the present time.

This improved wrench consists of a handle possessing at each of its ends a clamping head in the form of an open fork, ring or socket of polygonal crosssection, the two nut-engaging heads being arranged in two separate non-parallel planes and each being extended by a coplanar portion forming part of the handle.

It is characterized:

in that the two coplanar portions constitute the entire handle and intersect over the entire length of the latter;

and in that the straight line defined by the intersection of the two planes extends from one end of the handle to the other and along its diagonal over the entire length of the latter.

In other words, the invention involves producing a non-plane wrench, the two heads of said wrench being in two different planes extended in the region of the handle, in order to define a likewise non-plane handle, each of the plane parts performing the function of a girder for the other, thus resulting in an appreciable increase in the strength of this handle, especially its bending strength.

Advantageously, in practice:

the angle defined by the two planes is between 90° and 170°. It was found, in fact, that if this angle was larger than 170°, hence coming near to a configuration of the flat-wrench type, the disadvantages inherent in this configuration occurred again, namely on the one hand difficult grasping and on the other hand a relatively large overall size of the handle attributable to the composite structure, unsuitable for some uses; in contrast, if this angle was smaller than 90°, the configuration obtained is of little value because, although the overall size remains small, the grasping and actuation of the wrench are not made easier;

the two heads are in the form of a stationary or even movable open fork;

the wrenches are produced from plastic reinforced with glass fibers and possess in the region of the two heads a metal insert forming a clamping jaw or bit;

each of the heads has at its base a clearance intended for ensuring a better grip of the wrench and therefore better performances because the force which can be imparted to the wrench is greater; moreover, this clearance makes it possible to offer greater angular movement in accordance with the standards in force;

the straight line defined by the intersection of the two planes connects each of the two clearances;

the handle has a longitudinal slot through which passes the straight line defined by the intersection of the two planes an which is located in the vicinity of the middle of said handle in parallel with its two longitudinal edges. This slot is intended to allow easier storage of the wrenches;

the handle possesses on one of its main faces a relief and on the opposite face a corresponding recess intended to allow the wrenches to be stored by stacking or even snapping onto one another.

How the invention can be put into practice and the advantages which originate from it will emerge more clearly from the following exemplary embodiment given as a non-limiting indication with reference to the accompanying FIGS.

FIG. 1 is a perspective view of a composite wrench according to the invention.

FIG. 2 cross-section of this wrench taken at its center.

Figure 1:
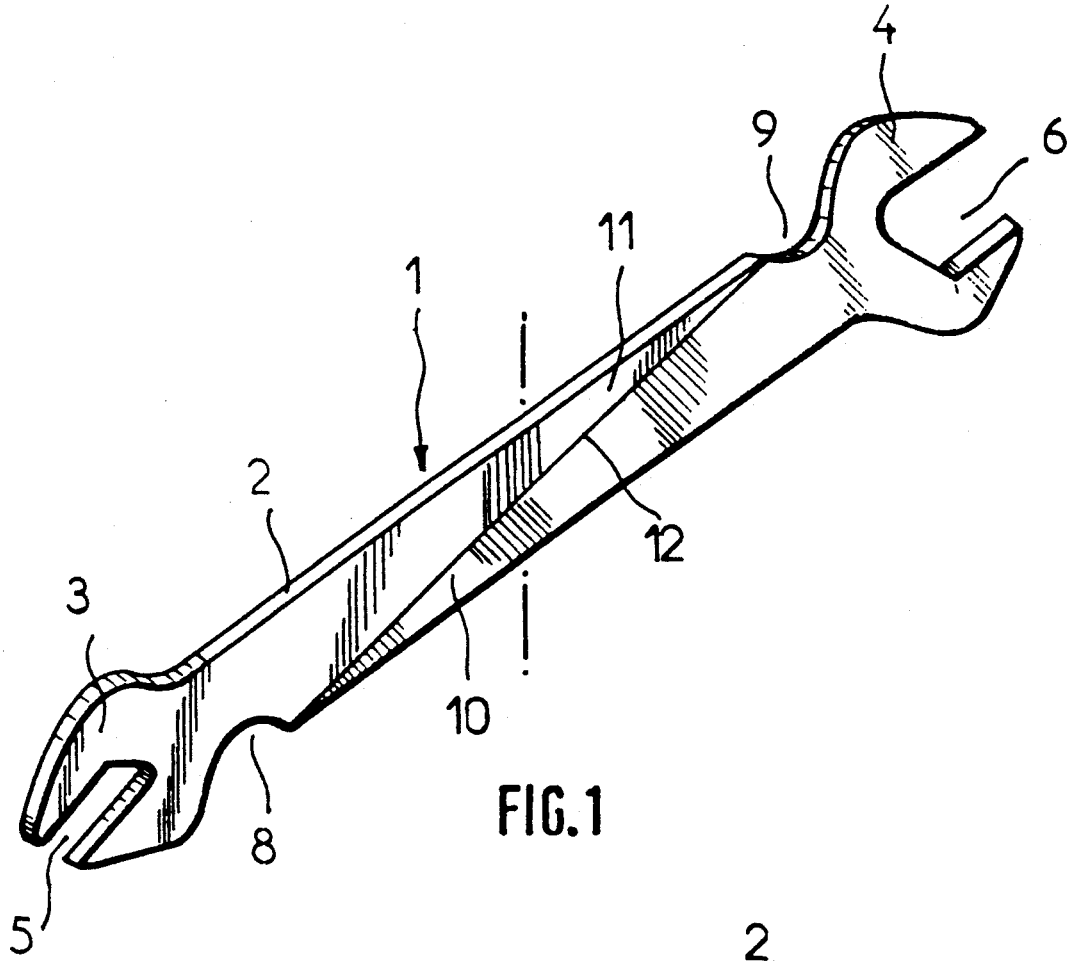
Figure 2:
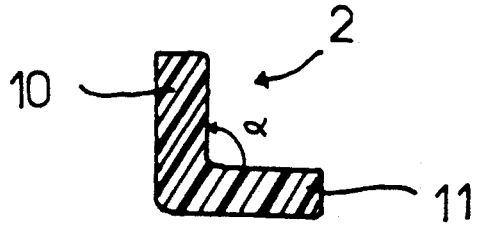

According to the invention, and as can be seen in FIG. 1, the composite wrench (1) consists fundamentally of a handle (2) having a nut-engaging head (3) and (4) at its two ends. In the example described, these nut-engaging heads are open forks (5) and (6).

The nut-engaging heads (3) and (4) possess in a known way a metal insert embedded in the component plastic of the assembly formed by the wrench (1). Advantageously, this plastic is reinforced with glass fibers in order to give it more strength and rigidity.

According to a fundamental characteristic of the invention, the two heads (3) and (4) are arranged in two different non-parallel planes. In fact, the heads (3) and (4) each have a coplanar extension (10) and (11) which, by being joined to one another, form the actual handle. Moreover, the two planes of the two heads (3) and (4) intersect in the region of the handle (2) along a straight line (12) extending substantially over the entire length of the handle (2) and more precisely along its diagonal. Thus, the handle obtained is not plane, but biplane, thereby defining an angle a. In this way, each of the respective extensions (10) and (11) performs the function of a girder in respect of the other, thereby significantly increasing the strength of the handle (2).

Furthermore, it should be noted that this structure and this arrangement allow the wrenches so produced to be gripped more easily, because it is sufficient to press on either one of the two heads (3) and (4) or on the extensions (10) and (11) of the handle (2) in order to bring the complementary part to the fore and thus grasp it.

In some special uses of the wrenches, a reduced overall size, particularly of the handle of such wrenches, is necessary. For this purpose, it is possible to decrease the angle a defined by the two planes to a value in the neighborhood of, for example, 90° ; its specific width is thereby reduced. Moreover, it thus becomes easier to grip the wrench so formed.

In another embodiment of the each of the heads (3,4) has at its base a respective cut-out that provide clearance (8, 9) symmetrical relative to one another in relation to the center of the wrench, allowing more efficient gripping and action on the wrench when large forces are exerted on it. In addition, these clearances make it possible to increase the angular movement of the wrench.

Figure 3:
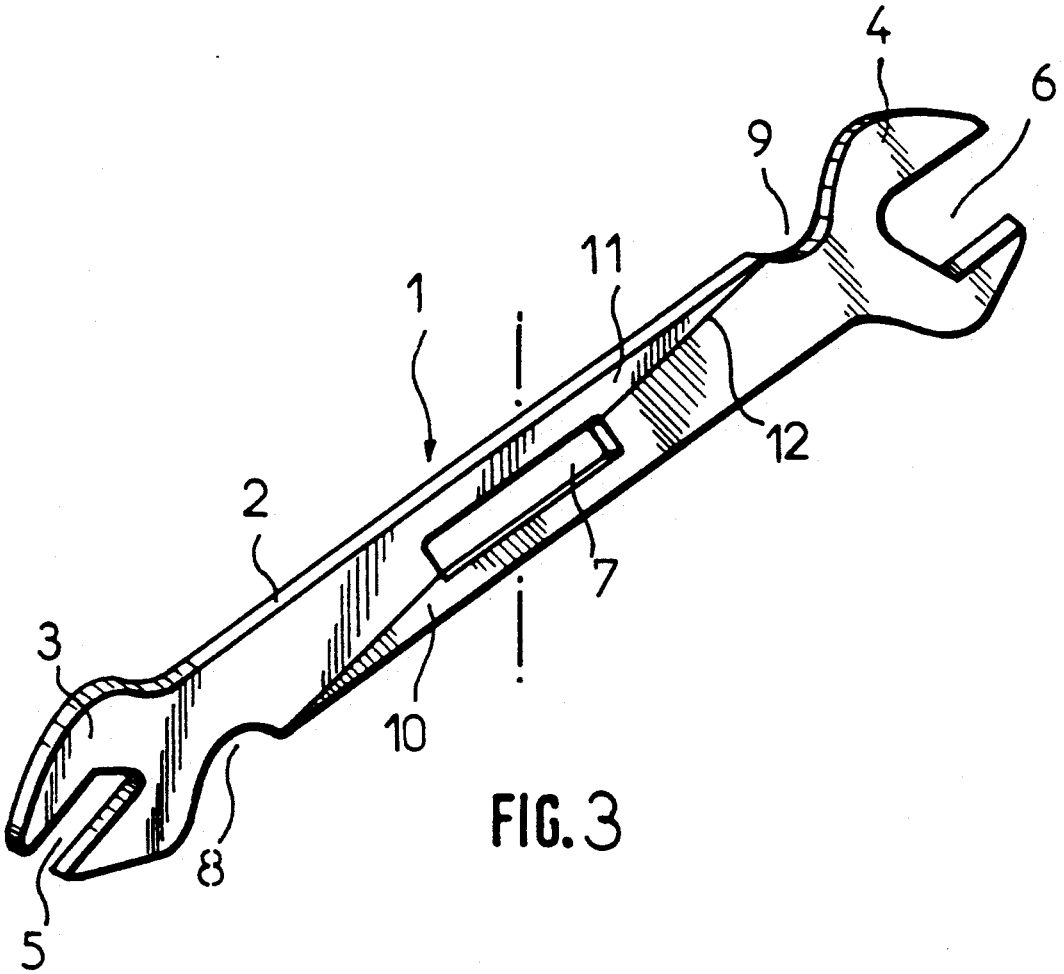
FIG. 3 is a perspective view of another embodiment of the wrench according to invention.
Figure 4:
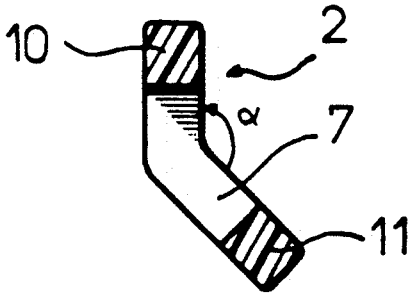
FIG. 4 is a cross-section of the wrench shown in FIG. 3.

In another embodiment illustrated in FIGS. 3 and 4, the handle (2) possesses at its center, in parallel with its two lateral edges, a longitudinal slot (7) through which the straight line (12) passes and which is intended to allow a plurality of wrenches of the type in question to be stored. In fact, by virtue of their construction, the wrenches have a V-shaped cross-section and, during storage, engage onto one another and onto a projection or tenon passing through the slot (7) of each of the wrenches.

In another embodiment not illustrated, one of the main faces of the handle (2) has a projection located towards the center of said handle. Correlatively, the opposite face of the handle (2) possesses a recess of corresponding shape, likewise located towards the center of the handle. These elements are intended to allow easier storage of the wrenches simply by engagement onto one another, the projection of one wrench interacting with the recess of the following or preceding wrench. These projections and recesses can even be produced in such a way that, during storage, there is not only engagement, but also snapping of one wrench onto the other by the exertion of a slight pressure on the wrenches.

These original wrenches can be produced by bending, cutting, injection, compression or any other suitable technique known for this type of use.

It emerges from the invention that, in the manner of other wrenches made of plastic, the wrenches described are light and insulating. Moreover, as in said wrenches, there is no sign in the course of time of either cracking phenomena or phenomena involving the detachment of the insert from the head. Furthermore, and above all, they have performances comparable to those of corresponding metal wrenches in view of the increase in the strength and rigidity of the handle as a result of the girder effect of one part of the handle on the other. Finally, by virtue of their structure and arrangement, they have the best possible ergonomics, making these wrenches much easier to grip, especially when the user has greasy fingers.

Finally, although the example described shows fork-shaped heads, it is perfectly possible to produce such wrenches, the two heads of which are sockets, or ring wrenches.

It should be noted that, although the foregoing description is concerned with composite wrenches, it is perfectly possible to consider wrenches produced entirely from steel and having the same characteristics, namely that the nut-engaging heads are arranged in two separate planes.

We claim:

1. An improved wrench, comprising:

an elongated handle having two ends; and a nut-engaging head at each end of the handle, said nut-engaging head having a configuration selected from the group of open fork, ring, and socket, each of polygonal cross section, said nut-engaging heads being arranged in two separate non-parallel planes and each being extended by a coplanar portion, wherein said coplanar portions intersect at a substantially constant angle alpha to form said handle and define a diagonal line of intersection that connects the two ends of the handle.

2. The wrench of claim 1, wherein said angle alpha is between 90 and 170 degrees.

3. The wrench of claim 1, wherein said wrench is constructed of plastic and said nut-engaging head each include an embedded metal insert means for engaging a nut.

4. The wrench of claim 3, wherein said plastic is reinforced by glass fibers.

5. The wrench of claim 1, wherein said handle includes a longitudinal slot and said secant passes through said slot.

6. The wrench of claim 1, wherein said handle has two opposing faces, one of said faces having a relief, and the opposite face having a recess that corresponds with said relief, whereby the relief and the recess respectively nest with a recess and a relief of similar wrenches when the wrenches are stacked for purpose of storage.

7. A wrench, comprising:

an elongated handle having two ends, two lateral edges, and a longitudinal slot; and a nut-engaging head at each end of the handle, said nut-engaging heads configured as an open fork of polygonal cross section, said nut-engaging heads being arranged in two separate non-parallel planes and each being extended by a coplanar portion, wherein said coplanar portions intersect to form said handle and define a straight diagonal line therein, said non-parallel planes intersecting at an angle of between 90 and 170 degrees, each of said nut-engaging heads further having a base and a cut-out at said base, said cut-outs being connected by said diagonal line;

wherein said wrench is constructed of plastic.

8. An improved wrench, comprising:

an elongated handle having two ends; and a nut-engaging head at each end of the handle, said nut-engaging head having a configuration selected from the group of open fork, ring, and socket, each of polygonal cross section, said nut-engaging heads being arranged in two separate non-parallel planes and each being extended by a coplanar portion, wherein said coplanar portions intersect at a substantially constant angle alpha to form said handle and define a diagonal line of intersection that extends between the two ends of the handle, said nut-engaging heads further having a base, said base having a cut-out that provides clearance, said cut-outs being connected by said diagonal line.

9. The wrench of claim 8 wherein said wrench is constructed of plastic and said nut-engaging heads each include an embedded metal insert means for engaging a nut.

10. The wrench of claim 9, wherein said plastic is reinforced by glass fibers.

11. The wrench of claim 8, wherein said handle includes a longitudinal slot and said diagonal line passes through said slot.

12. The wrench of claim 8, wherein said handle has two opposing faces, one of said faces having a relief, and the opposite face having a recess that corresponds with said relief, whereby the relief and the recess respectively nest with a recess and a relief of similar wrenches when the wrenches are stacked for purpose of storage.

* * * * *